United States Patent [19]

Soulen

[11] 3,965,016

[45] June 22, 1976

[54] COMPLEX ANTIMONY SULFIDES AS LUBRICANT ADDITIVES

[75] Inventor: John Richard Soulen, Narberth, Pa.

[73] Assignee: Pennwalt Corporation, Philadelphia, Pa.

[22] Filed: May 27, 1975

[21] Appl. No.: 580,859

[52] U.S. Cl. ..... 252/25

[51] Int. Cl.[2] ..... C10M 1/10; C10M 3/02; C10M 5/02; C10M 7/02

[58] Field of Search ..... 252/25

[56] References Cited

UNITED STATES PATENTS

| | | | |
|---|---|---|---|
| 3,377,277 | 4/1968 | Soulen | 252/25 |
| 3,851,045 | 11/1974 | Donohue | 252/25 |

*Primary Examiner*—Delbert E. Gantz
*Assistant Examiner*—I. Vaughn
*Attorney, Agent, or Firm*—Robert G. Danehower

[57] ABSTRACT

Complex sulfides of antimony are used as lubricant additives which are effective in imparting extreme pressure and anti-wear properties to lubricants.

2 Claims, No Drawings

COMPLEX ANTIMONY SULFIDES AS LUBRICANT ADDITIVES herein invention herein described was made in the course of or under a contract with the Department of the Navy.

This invention relates to lubricant compositions containing one or more complex sulfides of antimony as lubricant additives for imparting extreme pressure and anti-wear properties. These complex sulfides of antimony are amorphous solids intermediate in composition between the crystalline simple sulfides of antimony such as $Sb_2S_3$ and $Sb_2S_5$.

The complex sulfides of antimony are represented by the formula $Sb_aS_b$ where $a$ is within the range of about 1.7 to 2.3 and $b$ is within the range of about 3.6 to 4.4. The new lubricants are useful in applications involving elevated temperatures where thermally stable materials are required as distinguished from the prior art sulfides of non-metals or sulfur containing organic compounds which are more volatile and less thermally stable.

It is known that certain materials of lamellar crystal structure such as graphite, molybdenum disulfide, tungsten selenide, carbon monofluoride, and boron nitride can impart lubricating properties to greases, solid films, and other configurations in which they are employed. Of these, only graphite and molybdenum disulfide are used extensively commercially. I expected that the simple sulfide antimony trisulfide, which has a lamellar crystal structure, might be a superior lubricant. In standard Shell Four-Ball extreme pressure lubricant tests [1] greases containing 5% by weight of crystalline antimony trisulfide exhibited good anti-wear properties at low loads and reasonably good anti-weld properties at loads up to 282 kilograms.

[1] 10 sec, 1800 rpm, 77°F. A.I.S.I.-C-52100 chrome steel balls.

It is known that complex sulfides of arsenic and antimony have been used as ingredients in lubricating compositions but these materials have found only limited application. (See U.S. Pat. No. 3,777,277) One reason for the poor acceptance of these materials has been their high toxicity associated with the presence of arsenic. Another limitation is the rather low temperature range in which they melt, 200°–220°. It is also known that some other metallic sulfides perform a lubricating function between metal surfaces, for example, antimony pentasulfide, arsenic pentasulfide, complex zinc-antimony sulfide, stannic sulfide and the like (U.S. Pat. No. 2,421,543). However, as stated previously, $MoS_2$ is regarded as the best metallic sulfide lubricant known heretofore. It has also been disclosed in a government contract report, Basic Solid Lubricant Studies II, by W. H. Chappell, Contract N00019-71-C-0322, based on infrared spectrophotometric, microscopic and x-ray diffraction studies that complex sulfides, including thioantimonates or thiomolybdates and mixtures of sulfides with iron powder may be solid lubricants.

Surprisingly, I have discovered that complex antimony sulfides in which the lamellar configuration conductive to good lubrication is not preserved, have distinctly superior lubricating properties compared to the lamellar crystalline materials $Sb_2S_3$ and $MoS_2$.

The complex antimony sulfide compositions do not have a specific integral atomic ratio but have a range of varying atomic ratios as may be obtained by the methods of preparation described hereinafter. The complex sulfides of my invention are amorphous solids which are significantly more efficient as a lubricant additive than the crystalline metal sulfides of the prior art.

The complex sulfides embodied in this invention generally are incorporated in lubricant compositions in a particulate form, i.e., as a finely-divided powder having a particle size, in general, within the range of about 0.01 micron to about 100 microns, and preferably within the range of about 0.01 to 10 microns. The compositions embodied herein are useful for lubricating the contacting surfaces of a wide variety of materials, for example, metals such as steel, molybdenum, copper, zinc, bronze, brass, Monel and other metals and metal alloys, plastics, ceramics, graphite, and other materials, wherein the contacting surfaces may be of the same or different materials. The most important of these compositions are oil and grease compositions having improved extreme pressure and load-carrying ability which are prepared by incorporating in a conventional oil or grease from about 1 to about 60% by weight of the complex sulfides of this invention, preferably from about 2 to about 20% by weight of the composition. The conventional grease can be a natural petroleum grease, which may contain small amounts of antioxidants, anti-corrosives, or other additives; or a synthetic grease comprised of a synthetic ester such as dioctyl sebacate, dioctyl adipate, tributyl phosphate, di-2-ethyl hexyl sebacate, and the like, containing from about 5% to 45% of a thickener such as lithium stearate, aluminum stearate, lithium hydroxy-stearate, calcium stearate, silica, clay, and the like; and small amounts of other additives, such as antioxidants and anti-corrosion agents. Other greases which are improved by the complex sulfides silicone greases comprised of a silicone oil containing a thickening agent such as tetrafluoroethylene polymers and copolymers and other fluoropolymers. The complex sulfides also find utility as a component of a lubricating dispersion comprising a liquid oil carrier such as a hydrocarbon oil, synthetic ester oil, or silicone oil containing therein from about 1.0% to about 60% by weight of the solid sulfide particles, preferably from about 2 to 20% by weight based on a total weight of dispersion.

The lubricant additives of this invention may be obtained by fusion of antimony or antimony trisulfide with sulfur, or by fusion of antimony trisulfide and antimony pentasulfide, with or with addition of small amounts of sulfur. The products after cooling are ground, extracted with carbon disulfide or carbon tetrachloride to remove excess sulfur, and used as lubricant additives. Alternately, the antimony trisulfide can be converted to thioantimonite or thioantimonate ions which are soluble in water, and, by addition of a soluble salt of antimony in its + 3 oxidation state and adjustment of the pH, precipitates can be obtained which contain complex sulfides of antimony. In some cases reactions may not be complete but, if sufficient of the complex sulfide is formed, enhanced lubrication behavior is achieved in lubricating compositions. The following examples are illustrative of the preparation and testing of the lubricants of this invention.

EXAMPLE 1

A solution of 1.51 g $Sb_2O_3$ in 20 ml of 50% KOH was added slowly to a solution of 5.00 g $Na_3SbS_4 \cdot 9H_2O$ in 250 ml of $H_2O$ with stirring at 70C. On neutralization with HCl an orange red precipitate was formed. It was allowed to settle overnight and then it was washed free of acid with distilled water. It was then washed twice with 95% ethyl alcohol and dried in an oven at 95°C. The product, weighing 3.54 g, analyzed 65.5% Sb and 33.2% S, corresponding to the composition $Sb_{2.0}S_{3.86}$.

To additionally verify the composition and characterize the material, it was heated in a porcelain boat in a stream of nitrogen. It was found to melt at about 510°C., which is 300°C. higher than the corresponding complex sulfide of arsenic. After being held at 525°C. for 1.5 days, the sample was cooled and analyzed. It had lost 9.1% of its original weight which closely approaches the theoretical weight loss for conversion of $Sb_2S_4$ to $Sb_2S_3$, and the resulting product was identified as crystalline $Sb_2S_3$ by x-ray diffraction analysis.

EXAMPLE 2

In another preparation a solution of 5.83 g $Sb_2O_3$ in a large excess of 50% KOH (70g) was added to an equivalent amount (19.85g) of $2Na_3SbS_4 \cdot 9H_2O$ and diluted to a volume of 500 ml. This solution and a solution of 61.4 g of 37% HCl diluted to 500 ml were added simultaneously to 500 ml of vigorously agitated water. A dark flocculant precipitate was formed. After the additions were complete HCl was added to adjust the pH to 7 and the slurry was digested with stirring for one hour at 95°C. before it was allowed to cool. After several washings with water to remove chloride ion, it was rinsed with ethanol and acetone and dried overnight at 75°C. An overnight Soxhlet extraction was carried out in which less than 1% soluble material was removed. The final yield of product was 14 g, (94% of theory) of a reddish-brown powder similar in appearance to that obtained in Example 1. An x-ray diffraction powder pattern showed it to be amorphous.

EXAMPLE 3

A diester grease containing 5% of the complex antimony sulfide prepared in Example 2 was tested on the Shell Four-Ball extreme pressure lubricant tester under the standard conditions of 10 sec, 1800 rpm, 77°F, using AISI-C-52100 chrome steel balls. Comparison of the wear scar obtained with those from a grease employing the same concentration of crystalline $Sb_2S_3$ indicates that the weld point was substantially increased by the complex sulfide from 355 to 600 kilograms and that significantly decreased wear occurred in the intermediate load region before welding. These comparative anti-wear properties of the complex antimony sulfides were demonstrated by adding 5% weight of crystalline $MoS_2$ and $Sb_2S_3$ to separate lithium diester base grease and comparing it with 5% of amorphous $Sb_2S_4$ in the same grease base. The results are presented in Table 1 below.

TABLE I

| SHELL FOUR BALL EP TEST - CHROME STEEL BALLS | | | |
|---|---|---|---|
| Load in Kilograms | Wear Scar in Millimeters $MoS_2$ | $Sb_2S_3$(cryst.) | $Sb_2S_4$(amorph) |
| 40 | 0.33 | 0.33 | 0.34 |
| 80 | 0.41 | 0.43 | 0.45 |
| 120 | 0.50 | | 0.50 |

TABLE I-continued

| SHELL FOUR BALL EP TEST - CHROME STEEL BALLS | | | |
|---|---|---|---|
| Load in Kilograms | Wear Scar in Millimeters $MoS_2$ | $Sb_2S_3$(cryst.) | $Sb_2S_4$(amorph) |
| 140 | weld | 0.53 | |
| 160 | | | |
| 180 | | 1.66 | |
| 200 | | | 0.99 |
| 224 | | 1.91 | |
| 250 | | | 1.40 |
| 282 | | 2.00 | |
| 300 | | | 1.54 |
| 355 | | weld | |
| 400 | | | 1.50 |
| 500 | | | 1.60 |
| 600 | | | weld |

The high loadings and low wear scars for the amorphous $Sb_2S_4$ demonstrate significant superiority in extreme pressure properties as compared to the crystalline $MoS_2$ and $Sb_2S_3$.

In a similar test employing balls made with AISI-440C stainless steel, a very difficult to lubricant alloy, the complex antimony sulfide additive again provided superior lubrication. In addition the wear scar was only 0.53 mm at 160 kg load. For the commercially used lubricant $MoS_2$ in the identical test a wear scar of 2.43 mm. was obtained at 80 kg load and the balls welded together at 120 kg load.

EXAMPLE 4

The toxicity of the complex antimony sulfide prepared in Example 2 was compared with a complex or arsenic thioantimonate by placing quantities of each complex on both the normal skin and abraded skin of rabbit test animals. On abraded skin, the arsenic thioantimonate produced erythema, edema and ecchymosis and the skin area showed very little recovery after two weeks. The complex antimony sulfide on abraded skin produced erythma and edema while complete recovery of the area occurred in two weeks.

The above examples illustrate clearly that complex sulfides of antimony provide significantly improved performance as lubricant additives over that which can be provided by the simple trisulfide of antimony itself. Indeed, the lubricating ability of the complex antimony sulfides is far superior, and effective for a greater variety of metals, than the currently employed commercial molybdenum disulfide. In addition, the complex antimony sulfides provide much higher thermal stability and lower toxicity than related compositions containing arsenic.

I claim:

1. Lubricating compositions containing from about 1 to 60% by weight a complex sulfide of antimony represented by the formula $Sb_aS_b$ where $a$ is within the range of about 1.7 to 2.3 and $b$ is within the range of about 3.6 to 4.4.

2. Oil and grease compositions having improved extreme pressure and load carrying properties containing from about 1 to 60% by weight of a complex sulfide of antimony represented by the formula $Sb_aS_b$, where $a$ is within the range of about 1.7 to 2.3 and $b$ is within the range of about 3.6 to 4.4.

* * * * *